US005126625A

United States Patent [19]

Cho

[11] Patent Number: 5,126,625

[45] Date of Patent: Jun. 30, 1992

[54] MULTISTEP FOCUSING ELECTRON GUN FOR CATHODE RAY TUBE

[75] Inventor: Seok-rae Cho, Suwon, Rep. of Korea

[73] Assignee: Samsung Electron Devices Co., Ltd., Kyunggi-Do, Rep. of Korea

[21] Appl. No.: 636,108

[22] Filed: Dec. 31, 1990

[30] Foreign Application Priority Data

Dec. 31, 1989 [KR] Rep. of Korea ..... 89-20772

[51] Int. Cl.[5] ..... H01J 29/48; H01J 29/50; H01J 29/51

[52] U.S. Cl. ..... 313/414; 313/412; 313/413; 313/444

[58] Field of Search ..... 313/412, 413, 414, 444

[56] References Cited

FOREIGN PATENT DOCUMENTS 0050748 3/1982 Japan ..... 313/414
0198832 11/1983 Japan ..... 313/414
2224883 5/1990 United Kingdom ..... 313/414

*Primary Examiner*—Donald J. Yusko
*Assistant Examiner*—Nimeshkumar D. Patel
*Attorney, Agent, or Firm*—Cushman, Darby & Cushman

[57] ABSTRACT

A multistep focusing electron gun for a cathode ray tube includes at least a unipotential auxiliary lens and a bipotential major lens, wherein the electron beam-passing hole of the middle electrode supplied with a low potential among a successive three electrodes forming the unipotential auxiliary lens is formed in the form of a square and has a size so that the electron beam-passing holes of the electrode disposed at the front and at the rear of the middle electrode can be inscribed. The intensity of the unipotential auxiliary lens is weakened without reducing the mechanical strength of the electrode, and also the change of the relative position between the electrodes resulted from the structure change is inhibited.

4 Claims, 5 Drawing Sheets

MULTISTEP FOCUSING ELECTRON GUN FOR CATHODE RAY TUBE

FIELD OF THE INVENTION

The present invention relates to a multistep focusing electron gun for a cathode ray tube, and more particularly to an electron gun for a color cathode ray tube having an improved unipotential auxiliary lens.

BACKGROUND OF THE INVENTION

Referring to FIG. 1, a conventional multistep focusing electron gun for a color cathode ray tube comprises a cathode K, a control grid G1, and a screen grid G2 all together constituting a triode section, and also electrodes G3 to G8 constituting auxiliary lenses and a major lens of a main lens system, as shown in FIG. 1. In a conventional multistep focusing electron gun having the above construction, a voltage below 1 KV is supplied to the electrodes G2, G4, and G6, a voltage below 10 KV is supplied to the electrodes G3, G5, and G7, and a voltage below a maximum 30 KV is supplied to the anode, i.e. the electrode G8. At this time, a first focus voltage of a certain potential is supplied to the electrodes G3, G5, and G7, and a second focus voltage lower than the first focus voltage is supplied to the electrodes G2, G4 and G6. According to the voltage supplying method, a first unipotential static lens is formed by the electrodes G3, G4, and G5, a second unipotential static lens is formed by the electrodes G5, G6, and G7, and a bipotential static lens is formed by the electrodes G7 and G8.

Referring to FIG. 2, in this same conventional multistep focusing electron gun for a cathode ray tube, after thermal electrons emitted from the cathode K are formed into an electron beam by the electrodes G1 and G2, the beam is preliminarily accelerated through the first unipotential static lens and the second unipotential static lens, and is finally focused and accelerated by the bipotential static lens. At this time, the electron beam is gradually diverged while passing the first and second unipotential static lenses, in which the diverging angle $\theta 2$ of the electron beam in the second unipotential static lens is larger than the diverging angle $\theta 1$ in the first unipotential static lens.

The reason for such gradual divergence is that an electron beam passing through hole H of the electrode G6 among the electrodes G5 to G7 which constitute the second unipotential static lens, has a diameter equal to those of electron beam-passing holes of the electrodes G5 and G7 respectively disposed at the front and at the rear of the electrode G6, and the thickness T of the electrode G6 is relatively thick.

Accordingly, this conventional electron gun cannot provide a good focus characteristic. In this electron gun, to form an electron beam having a good focus characteristic, the diverging angle of the second unipotential static lens should be reduced. To reduce the diverging angle, the thickness T of the electrode G6 should be reduced or the electron beam-passing hole H of the electrode G6 should have a diameter larger than those of the electron beam-passing holes of the adjacent electrodes G5 and G7 disposed respectively at the front and the rear of the electrode G6. However, there is a limitation in reducing the thickness of an electrode because a thin thickness T of the electrode G6 deteriorates its mechanical strength, thereby causing the electrode G6 to be subject to deformation by a compressive force applied when all of the electrodes are fixed to supporting beads. When the electron beam-passing hole H of the electrode G6 is formed so as to be larger than those of the electrodes which are respectively at the front and at the rear of the electrode G6, the positions can not be exactly set by the guide rod for setting the relative position to be inserted to the electron beam-passing hole while the electrodes are being assembled into one structure, thereby deteriorating the degree of precision with which the electrodes are assembled to form an electron gun.

SUMMARY OF THE INVENTION

It is an object of the present invention to provide a multistep focusing electron gun for a cathode ray tube, whose structure is improved so as to have a good focus characteristic.

To achieve the above object, there is provided a multistep focusing electron gun for a cathode ray tube comprising at least a unipotential auxiliary lens and a bipotential major lens, wherein the electron beam-passing hole of the middle electrode supplied with a low potential among a successive three electrodes forming the unipotential auxiliary lens is formed in the form of a square and has a size such that the electron beam-passing holes of the electrodes disposed at the front and at the rear of the middle electrode can be inscribed.

BRIEF DESCRIPTION OF THE DRAWINGS

The above object and other advantages of the present invention will become more apparent from the following description of the preferred embodiments of the present invention made with reference to the attached drawings, in which.

DESCRIPTION OF THE PREFERRED EMBODIMENTS

Hereinafter, a preferred embodiment of the present invention will be explained with reference to the attached drawings.

Figure 1:
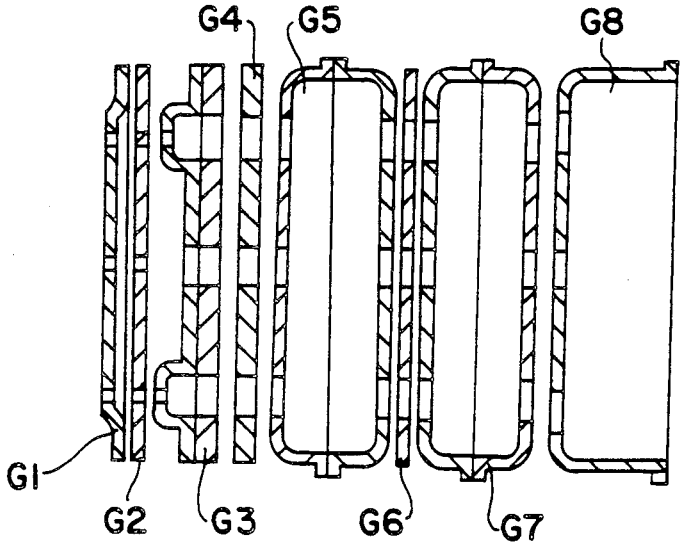
FIG. 1 (PRIOR ART)
FIG. 1 is a longitudinal cross-sectional view of a conventional multistep focusing electron gun.
Figure 2:
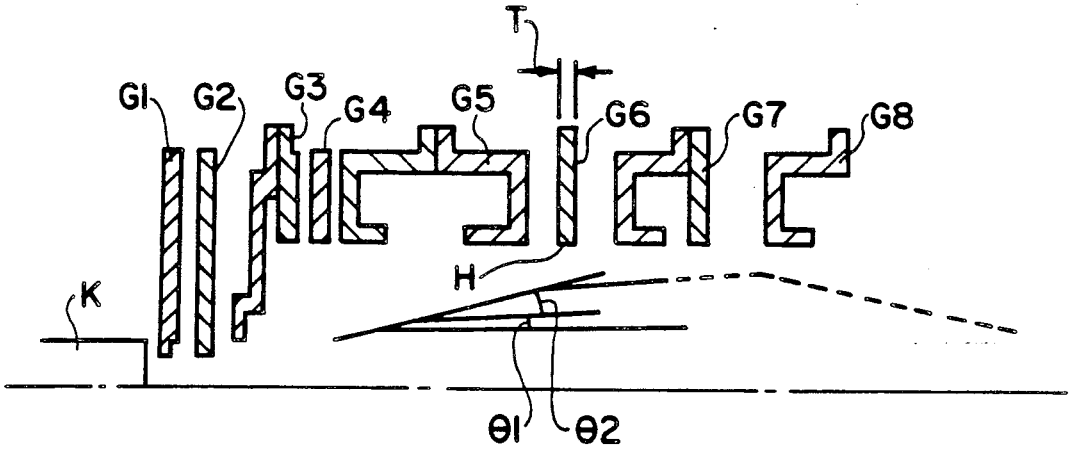
FIG. 2 (PRIOR ART)
FIG. 2 is a larger scale, fragmentary logitudinal cross section view of the electron beam in the conventional electron gun shown in FIG. 1, for two-dimensionally showing the diverging and focusing states thereof.

An electron gun of the present invention having, generally the same structure as of the conventional electron gun shown in FIG. 1, comprises a cathode, electrodes G1 and G2 all together constituting a triode, electrodes G3 to G7 constituting first and second auxiliary lenses and a major lens of a main lens system, and an anode G8. In use, a focus voltage below 10 KV is supplied to the electrodes G3, G5, and G7, a static voltage below 1 KV is supplied to the electrodes G2, G4 and G6, and a anode voltage below 30 KV is supplied to the electrode G8.

Accordingly, a first unipotential auxiliary lens is formed by the electrodes G3, G4, and G5, a second unipotential auxiliary lens is formed by the electrodes G5, G6, and G7, and a major lens is formed by the electrodes G7 and G8.

Figure 3:
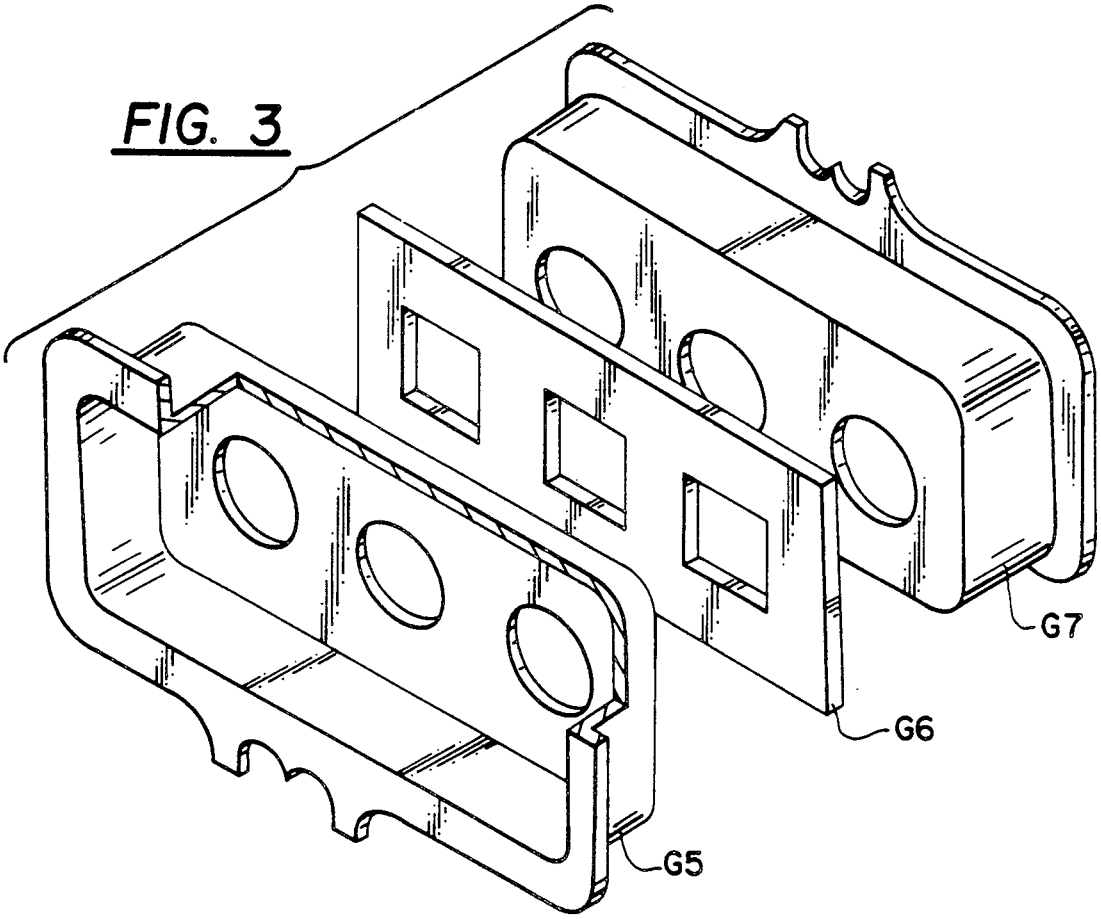
FIG. 3 is an exploded perspective and somewhat schematic view of the principal parts of a multistep focusing electron gun for a cathode ray tube according to the present invention.
Figure 4:
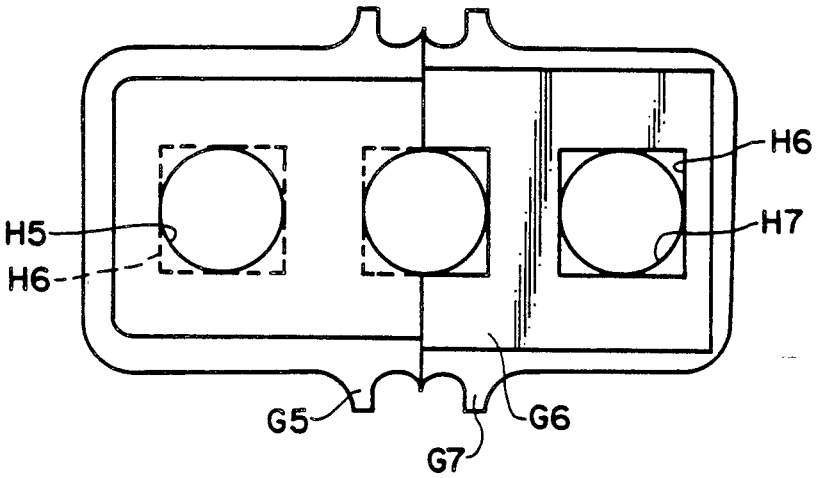
FIG. 4 is a front elevation view of the electrodes shown in FIG. 3, when viewed in the direction of passage of the electrodes beam.

In the electron gun of the present invention, the electrodes G5, G6, and G7 of the second unipotential auxiliary (lens which is a characteristic part) have the construction shown in FIGS. 3 and 4. Each electrode is provided with three electron beam-passing holes of the in-line type, and all of the beam passing holes of each electrode are disposed in a plane. The electron beam-passing holes H5 and H7 of the electrodes G5 and G7 are in the form of circles having an identical diameter, and the electron beam-passing hole H6 of the electrode G6 disposed between the above electrodes is in the form of a square in which the length of each side is as long as the diameter of the electron beam-passing holes H5 and H7 of the electrodes G5 and G7, so that the electron beam-passing holes H5 and H7 of the electrodes G5 and G7 can be inscribed therein.

Figure 5:
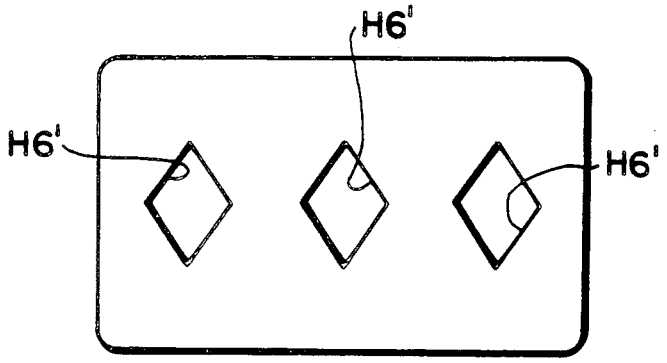
FIG. 5 and FIG. 6 are front elevation views of the electrons applicable to other preferred embodiments of the present invention.

According to another preferred embodiment of the present invention, as shown in FIG. 5, the electrode G6 has an electron beam-passing hole H6' in the form of a rhombus, where the electron beam-passing hole H6' is also sized to circumscribe the electron beam-passing holes H5 and H7 of the electrodes G5 and G7 disposed at the front and at the rear of the electrode G6.

Figure 6:
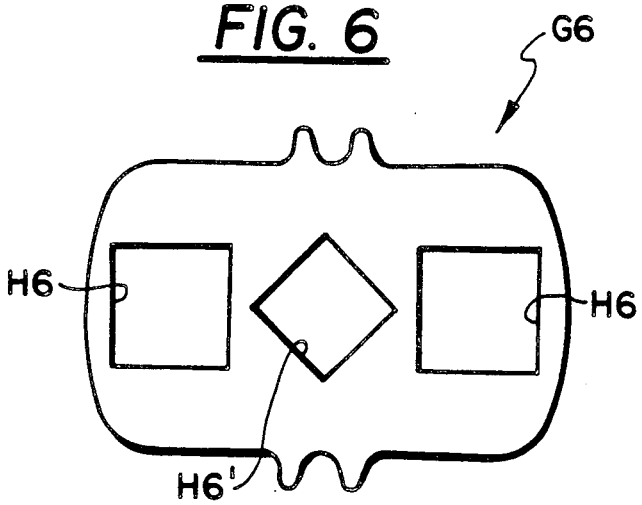

According to the third preferred embodiment of the present invention, FIG. 6 the electrode G6 has two electron beam-passing holes H6 in the form of a square at both ends and an electron beam-passing hole H6' in the form of a rhombus at the center, in which all of the electron beam-passing holes H6, and H6' are sized to circumscribe the electron beam-passing holes H5 and H7 of the electrodes disposed at the front and at the rear of the electrode G6.

The operation of a multistep focusing electron gun for a cathode ray tube of the present invention provided with above described electrode G6 is explained hereinbelow.

The electron beam is generated by the electron gun triode section, composed of a cathode K, the electrodes G1 and G2 is preliminary focused and accelerated by a first unipotential auxiliary lens composed of the electrodes G2, G4, and G5, and a second unipotential auxiliary lens composed of the electrodes G5, G6, and G7, and then is finally accelerated and focused by a bipotential major lens composed of the electrodes G7 and G8, to be imaged on a screen. At this time, the square electron beam-passing holes H6 and H6' are larger than the electron beam-passing holes H5 and H7 of the electrode G5 and G7 disposed at the front and at the rear of the electrode G6, thereby having a weaker diverging force than that of the first unipotential auxiliary lens formed at the front thereof. Accordingly, the incidence angle of the electron beam entering the major lens is reduced by the second unipotential auxiliary lens of much weaker diverging force, thereby improving the focus characteristic of the electron beam so as to provide a desirable electron beam spot on a screen.

Figure 7A:
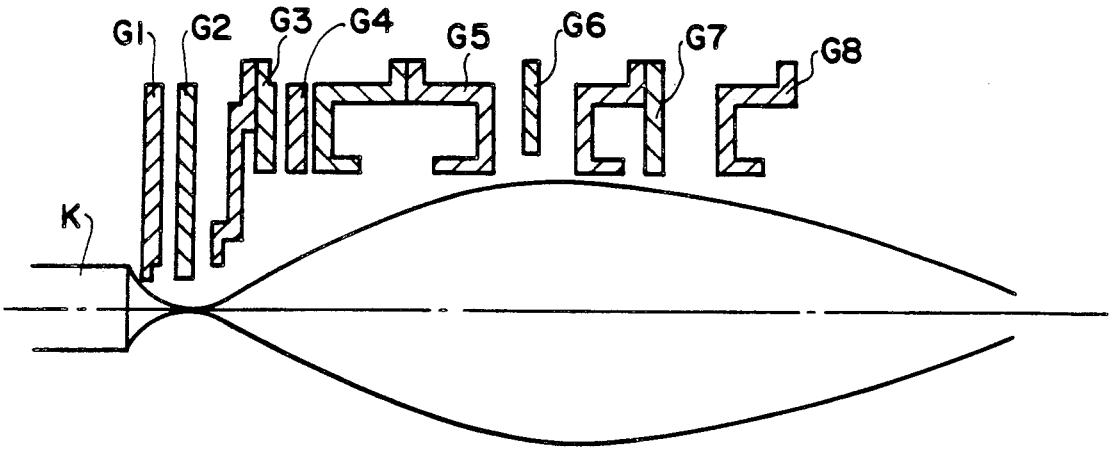
FIG. 7A is a fragmentary longitudinal cross-sectional view (comparable to FIG. 3), which illustrates the controlling state of the electron beam in the electron gun according to the present invention.
Figure 7B:
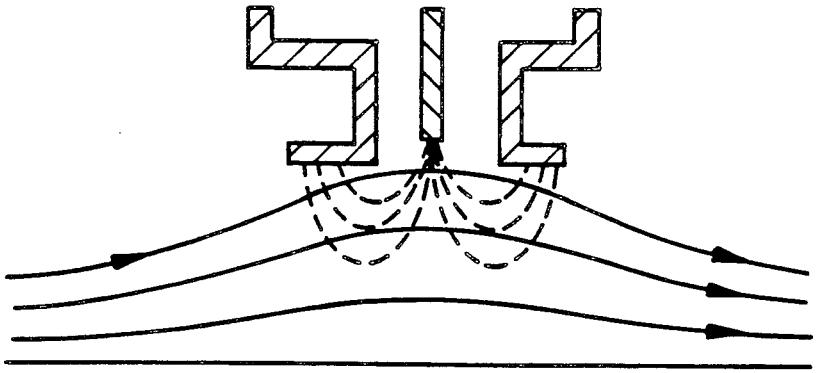
FIG. 7B is an extracted, enlarged illustration of a portion of the apparatus and been shown in FIG. 7A.

Referring to FIG. 7, a high-potential focus voltage (below 10 KV) is supplied to the electrodes G5 and G7, and a low-potential focus voltage (below 1 KV) is supplied to the electrode G6 disposed between the electrodes G5 and G7, so that a unipotential auxiliary lens is formed by the electrodes G5, G6, and G7. Accordingly, the electron beam is decelerated and diverged while passing through the electrodes G5 and G6, and accelerated and focused while passing through the electrodes G6 and G7. When the electron beam is controlled by the electrodes, the electron beam-passing hole H6 of the electrode G6 is larger than the electron beam-passing holes at the front and at the rear of the electrode G6, thereby preferably decreasing the diverging angle of the electron beam between the electrodes G5 and G6, so as to reduce the desired incidence angle to the major lens of the electron beam.

A multistep focusing electron gun according to the present invention, which compensates the deflection astigmation caused by deflection yoke to improve the color purity of the picture of the cathode ray tube as set forth below.

Figure 8:
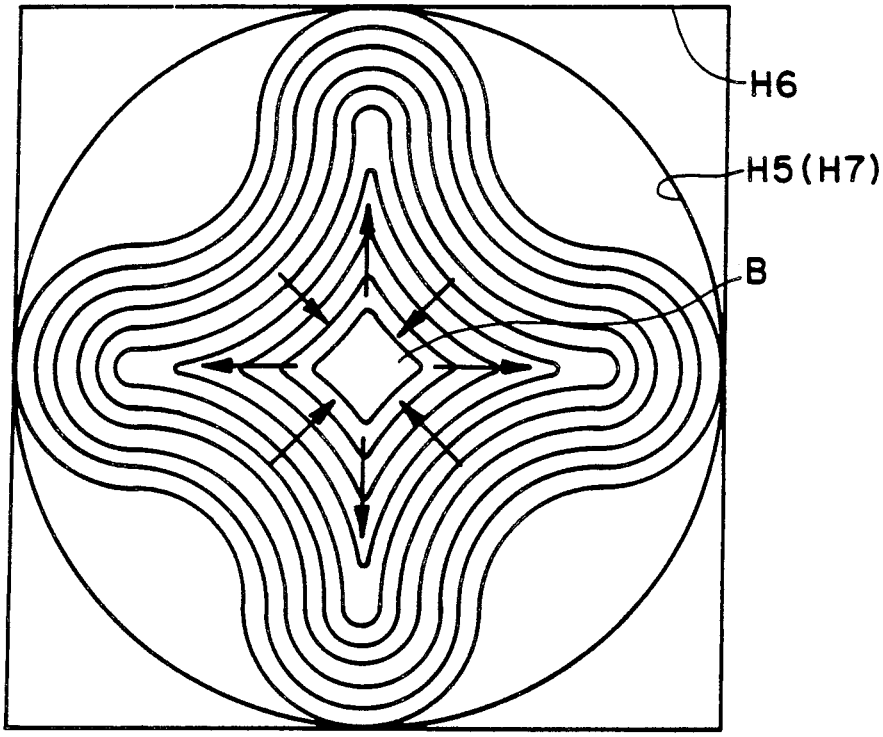
FIG. 8 illustrates controlling state of the electron beam in the electron gun of the present invention by way of equipotential lines.

As shown in FIG. 8, the insides of the square-type electron beam-passing hole H6 of the electrode G6, and the circle-type electron beam passing holes H5 and H7 of the electrodes positioned at the front and at the rear of the electrode G6, in which the circle-type holes H5 and H7 are inscribed in the square-type hole H6, have such potential distributions that are different at the four contacts of the circular holes H5 and H7 and the square hole H6 and around the four corners of the square hole H6.

Figure 9:
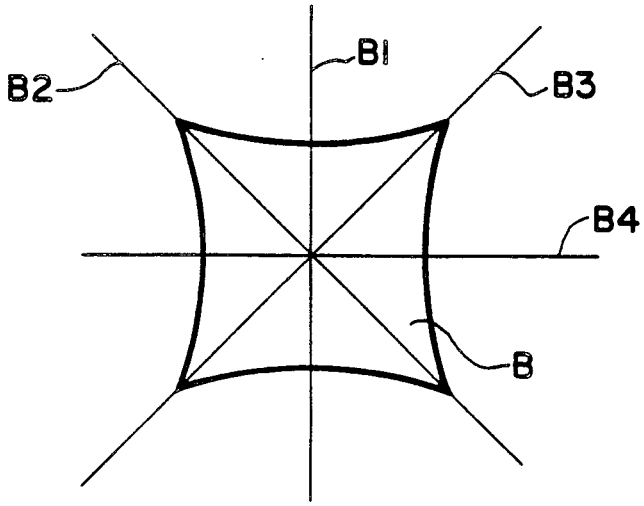
FIG. 9 shows an electron beam section controlled by the electron gun of the present invention.

Accordingly, the electron beam B passing the above electrodes is forced in the direction of the arrow as shown in FIG. 8. As a result, the cross-sectional form of the electron beam B which has passed the electrodes is extended in the diagonal directions B2 and B3 and is shrunk in the horizontal and vertical directions B1 and B4, so as to be orthogonally outwardly concave, as shown in FIG. 9.

The electron beam B having the above-mentioned cross-section passes through the major lens to be finally focused and accelerated. Then, when the electron beam is deflected towards the surroundings of the screen by the deflection yoke, the deflection astigmation of the electron beam by the deflection yoke is compensated for by the flare of the beam in the diagonal direction according to the curvature variation of the screen surface, thereby obtaining a uniform beam spot.

As shown in FIG. 5, the electron beam-passing hole H6 of the electrode G6 is formed in a rhombus that is made by rotating a square by approximately 45°, and the vertical length is extended longer than the horizontal length. That is, the cross-section of the electron beam becomes a longitudinally extended form, so that the deflection astigmation is compensated for, to improve the resolution in the whole screen when the electron beam B is deflected towards the surroundings of the screen surface by the deflection yoke.

In the electron gun of the present invention having a good focus characteristic by controlling an electron beam, the electron beam-passing hole H6 of the central electrode G6 is larger than the electron beam-passing holes H5 and H7 of the electrodes G5 and G7 disposed at the front and the rear thereof in such a manner that the electron beam-passing holes H5 and H7 can be inscribed in the electron beam-passing hole H6 of the central electrode G6. Thus, in the present invention, when the electrodes are assembled, the edges of the electron beam-passing holes of all of the above described electrodes partially or wholly contact the surface of the guide rod inserted through the electrode beam-passing holes of the electrodes, thereby keeping the precise relative positions between the electrodes.

As described above, the present invention is characterized in that the intensity of the unipotential auxiliary lens is weakened without reducing the mechanical strength of the electrode, and also the change of the relative position between the electrodes resulted from the structure change is inhibited. The present invention is not limited in the above-described preferred embodiments, but is applicable to any other electron gun having at least one unipotential auxiliary lens.

What is claimed is:

1. A multistep focusing electron gun for a cathode ray tube having at least one unipotential auxiliary lens ranked in front of a bipolar major lens, wherein:

said unipotential auxiliary lens comprises three successive electrodes including a front electrode, a center electrode and a rear electrode;

a cathode ranked in front of said unipotential auxiliary lens and an anode ranked rearwardly of said bipolar major lens; at least one set of axially aligned holes including a respective hole provided in each of said front, center and rear said electrodes of said unipotential auxiliary lens, said bipolar main lens and said anode, so that an electron beam generated at said cathode must pass through all said holes of each said set to reach a screen when such screen is ranked rearwardly of said anode, when said center electrode of said unipolar auxiliary lens is provided with a lower potential than said front and rear electrodes of said unipolar auxiliary lens;

for each said set said holes through said front and rear electrodes being substantially circular in outer peripheral figure, said hole through said center electrode being substantially rhombic in outer peripheral figure thereby being a rhombic hole, and said rhombic hole through said center electrode having said holes through said front and rear electrodes inscribed therein, as seen in end elevation.

2. The multistep focusing electron gun of claim 1, wherein:

each said rhombic hole is substantially square in outer peripheral figure.

3. The multistep focusing electron gun of claim 1, wherein:

said gun is arranged so that, when said gun is in use, all of said holes in each said set of holes are aligned along a substantially horizontal axis, and each said rhombic hole is taller than it is wide.

4. The multistep focusing electron gun of claim 1, wherein:

there are three of said sets of holes provided in said electrodes, for passing a respective three electron beams.

* * * * *